US009293283B2

(12) United States Patent
Colombo et al.

(10) Patent No.: US 9,293,283 B2
(45) Date of Patent: Mar. 22, 2016

(54) ARMOURED RESISTOR WITH AN END SEALING ELEMENT

(75) Inventors: Roberto Colombo, Conegliano (IT); Gianni Palu', Santa Lucia di Piave (IT); Maurizio Biasi, Fontanelle (IT)

(73) Assignee: I.R.C.A. S.P.A. INDUSTRIA RESISTENZE CORAZZATE E AFFINI, San Vendemiano (IT)

( * ) Notice: Subject to any disclaimer, the term of this patent is extended or adjusted under 35 U.S.C. 154(b) by 454 days.

(21) Appl. No.: 13/701,265

(22) PCT Filed: May 31, 2011

(86) PCT No.: PCT/EP2011/058892
§ 371 (c)(1),
(2), (4) Date: Feb. 15, 2013

(87) PCT Pub. No.: WO2011/151303
PCT Pub. Date: Dec. 8, 2011

(65) Prior Publication Data

US 2013/0200985 A1 Aug. 8, 2013

(30) Foreign Application Priority Data

May 31, 2010 (IT) ..... RM2010A0291

(51) Int. Cl.

| | |
|---|---|
| ***H05B 3/44*** | (2006.01) |
| ***H01H 37/76*** | (2006.01) |
| ***H05B 3/04*** | (2006.01) |
| ***H05B 3/06*** | (2006.01) |
| ***H05B 3/42*** | (2006.01) |
| ***H01C 17/02*** | (2006.01) |

(52) U.S. Cl.
CPC ..... *H01H 37/761* (2013.01); *H01C 17/02* (2013.01); *H05B 3/04* (2013.01); *H05B 3/06* (2013.01); *H05B 3/42* (2013.01); *Y10T 29/49087* (2015.01)

(58) Field of Classification Search
CPC ..... H01H 37/761; H01C 17/02; H05B 3/04; H05B 3/06; H05B 3/42; Y10T 29/49087
See application file for complete search history.

(56) References Cited

U.S. PATENT DOCUMENTS 4,346,287 A * 8/1982 Desloge ..... 219/541

FOREIGN PATENT DOCUMENTS

| | | | |
|---|---|---|---|
| DE | 9410403 | * | 8/1994 |
| DE | 19535389 | * | 3/1997 |
| JP | 2003068433 | * | 3/2003 |

* cited by examiner

*Primary Examiner* — Shawntina Fuqua
(74) *Attorney, Agent, or Firm* — Davis, Malm & D'Agostine, P.C.

(57) ABSTRACT

Armored resistor with an end sealing element in which the electric pin (2) partially projecting from an end (1') of the armor (1) and connected to said end by said sealing element (5) is provided with a part (22) with high roughness, i.e. knurling and/or toothing (22', 22'', 22''') and/or a circular groove (23, 23'), moreover said end (1') of the armor is crimped in order to compress said sealing element (5) against said zone with high roughness.

12 Claims, 4 Drawing Sheets

ARMOURED RESISTOR WITH AN END SEALING ELEMENT

FIELD OF THE INVENTION

The present invention relates to an armoured resistor with an end sealing element.

PRIOR ART

Armoured resistors are used in household appliances that come in contact with water, such as washing machines, dishwashers and the like.

These armoured resistors can incorporate safety devices which, if the equipment or any component thereof malfunctions, eliminate the risk of fire thereof. In particular, thermal fuses can be incorporated, capable of cutting off the power supply to the resistor when it exceeds a predetermined temperature.

These resistors are formed by a resistance wire inserted coaxially in tube-shaped metal armour and filled with powder of an electrical insulator, for example magnesium oxide.

Corresponding to each end of the tube-shaped armour there is a projecting metal electric pin, suitably isolated electrically from the tube-shaped armour, both caps being intended to be connected to a power supply.

A thermal fuse can be present at one or both of said ends. In particular the thermal fuse is connected electrically and mechanically by a first conducting wire to said electric pin, in the portion inside said tube-shaped armour, and is connected electrically and mechanically by a second conducting wire to a metallic element, to which, said resistance wire is connected.

Corresponding to each end of the armour, suitable seals are provided between the electric pin and the armour. These seals have the following functions:

- they prevent the magnesium oxide powder escaping from the resistor and, at the same time, they prevent ingress of moisture into said resistor,
- they keep the electric pin integral with the armour and in particular coaxial with it and isolated electrically from it.

The seal is generally made with resins, for example epoxy or polyurethane resins. This necessitates carrying out particularly complicated polymerization processes using special equipment, requiring a high degree of precision.

For these reasons, the prior art proposes the use of silicone insulating material with characteristics of water repellence and of beads of plastic or ceramic for mechanical fixing of the electric pin to the armour. With this solution, the bead is only required to have a function of sealing with respect to the insulating powder, so that it does not escape from the resistor, whereas it is no longer also necessary for it to have characteristics of sealing against moisture.

The presence of a thermal fuse makes it essential to ensure perfect stability for the electric pin relative to the armour. In fact, in resistors without the thermal fuse the electric pin is blocked by the magnesium oxide. In resistors in which at least one electric pin is connected electrically to a thermal fuse, the electric pin cannot be blocked in the magnesium oxide owing to the presence of the thermal fuse.

U.S. Pat. No. 7,496,284 describes a method of thermally deforming a bead, so that it seals the end of the resistor. According to another variant described, it is envisaged that the end of the armour is deformed around the bead. In accordance with that document, tests demonstrated insufficient stability of the electric pin, with consequent damage of the thermal fuse.

Patent DE19535389 shows a circumferential groove made in the electric pin for the purpose of improving adhesion between the electric pin and the bead in order to improve the moisture-proofness of an armoured resistor. This solution does not, however, solve the problem of strengthening the adhesion between electric pin and bead for the purposes of improving the mechanical strength of the assembly.

SUMMARY OF THE INVENTION

The purpose of the present invention is to provide an armoured resistor with an end sealing bead that is able to solve the aforementioned problem.

The present invention relates to an armoured resistor with an end sealing bead.

According to a main aspect of the invention, the armoured resistor comprises at least one thermal fuse connected electrically and mechanically to a metal electric pin having longitudinal extension. This electric pin, at least in a portion thereof in contact with said sealing bead has a surface shape at least locally asymmetric relative to said longitudinal extension, and in particular comprises at least one protuberance or a surface groove arranged obliquely or parallel to said axial extension and preferably parallel.

It has been found that teeth are always much more effective than knurling, as teeth offer better interpenetration of the bead or bushing and the teeth of the electric pin, ensuring better axial resistance of the latter. This is essentially because the fluorinated materials used are significantly rigid.

Knurling, relative to teeth, comprises grooves that are perpendicular to one another. Thus, teeth comprise only grooves that are parallel to one another.

These grooves/protuberances defined by the teeth solve the problem of ensuring torsional stability for the electric pin/bead assembly, much better than knurling.

Another objective of the present invention is to provide a method of assembly of an armoured resistor with a sealing bead able to solve the aforementioned problem.

The present invention also relates to a method of assembly of an armoured resistor with an end sealing element.

According to a preferred embodiment of the invention, the armour is crimped corresponding to one end from which a electric pin projects, in order to compress said bead against said part with high roughness.

According to another preferred embodiment of the invention, corresponding to a thermal fuse, an electrically insulating bushing is present, and the bushing and the sealing bead are contiguous, and a sealing gasket, preferably an O-ring, is interposed between them.

Advantageously, according to this embodiment, the resistance of the armoured resistor to moisture and to the intrusion of foreign bodies is improved.

The dependent claims describe preferred embodiments of the invention, forming an integral part of the present description.

BRIEF DESCRIPTION OF THE DRAWINGS

Further characteristics and advantages of the invention will become clearer from the detailed description of preferred, but not exclusive, embodiments of an armoured resistor with an end sealing bead, illustrated as non-limiting examples, referring to the appended drawings in which.

The same reference numbers and the same reference letters in the figures identify the same elements or components.

DETAILED DESCRIPTION OF A PREFERRED EMBODIMENT OF THE INVENTION

Figure 7:
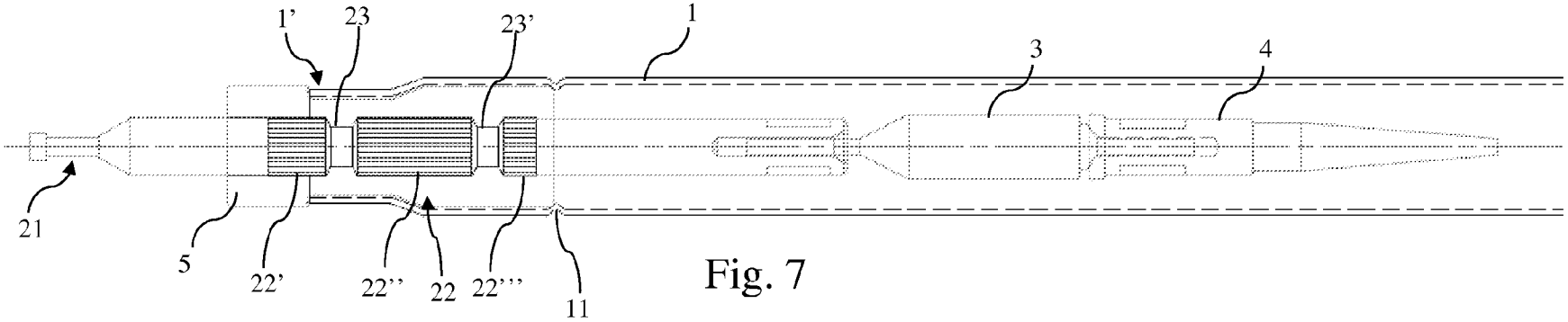
FIG. 7 shows, in axial section, a complete portion of the armoured resistor.

Referring to FIG. 7, an example of application of the present invention comprises armour 1, preferably tube-shaped, i.e. with axial extension, which houses within it a metal electric pin 2 partially projecting relative to an end 1' of the armour 1, a thermal fuse 3, connected by a first conducting wire to said electric pin 2 and by a second conducting wire to an internal metallic element 4 which can be connected to a resistance wire, not shown in this figure.

Referring to the figures, the metal electric pin 2 has globally cylindrical symmetry defining a longitudinal extension X, generally coinciding with the axial extension of the armour, and comprises a first tapered part 21 of electrical and mechanical interconnection with a respective external electrical connector (not shown).

The metal electric pin 2 is held in position relative to the armour by a sealing element 5, commonly called a bead.

A second cylindrical part 22 has high roughness for the purpose of providing a high coefficient of friction corresponding to the contact zone with the sealing bead 5. This can therefore be interposed between the electric pin 2 and the end 1' of armour 1, in order to hold the metal electric pin in position and in order to seal the inside of the armour.

A preferred sealing bead 5 has cylindrical shape, hollow internally, and more generally has axial symmetry with an external surface compatible with the shape of the armour and an internal through-cavity, compatible with the shape of the electric pin.

Preferably, said second part 22, in contact with the bead, comprises at least one longitudinal surface protuberance and/or a one longitudinal groove, for example knurling continuous at least in parts, in order to ensure static adhesion between electric pin and sealing bead capable of resisting torsional stresses. In other words, even if a torque is applied to the electric pin, the latter does not turn relative to the bead 5.

Figure 5:
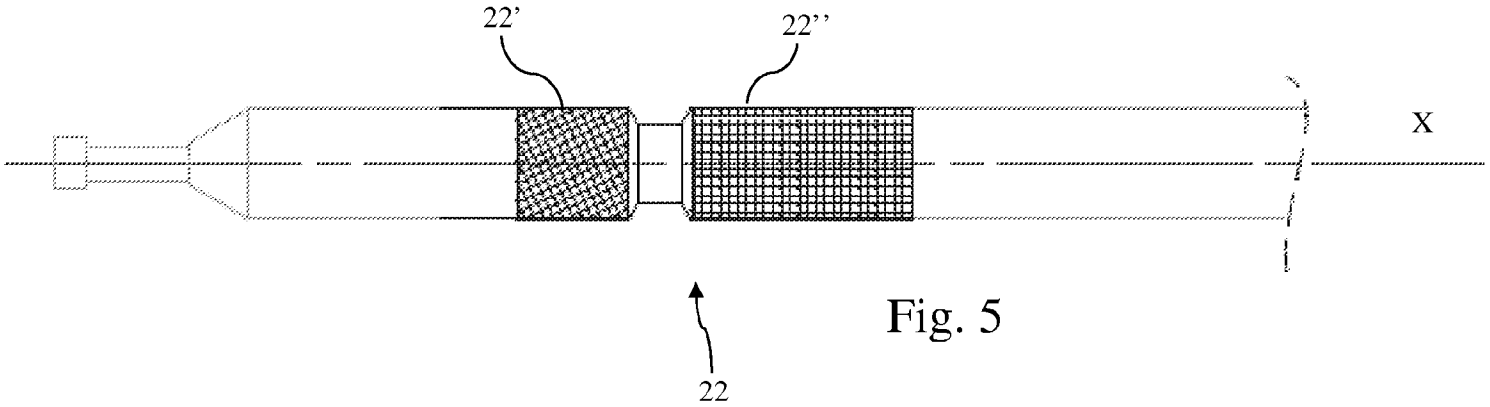
FIG. 5 shows, in axial section, a second variant of the component in FIG. 2.

In FIG. 5, said second part 22 comprises a first portion 22' knurled at a first angle and a second part 22' knurled at a second angle different from the first. According to this variant, even if the electric pin still has a globally symmetric shape and in particular cylindrical relative to the longitudinal extension X, locally it is asymmetric through the presence of the teeth of the knurling.

According to the variants in FIGS. 2, 6, 7 and 8 the second part comprises teeth with a longitudinal extension, i.e. coinciding with the longitudinal extension of the electric pin 2.

Combinations of the variants illustrated can be envisaged.

Figure 1:
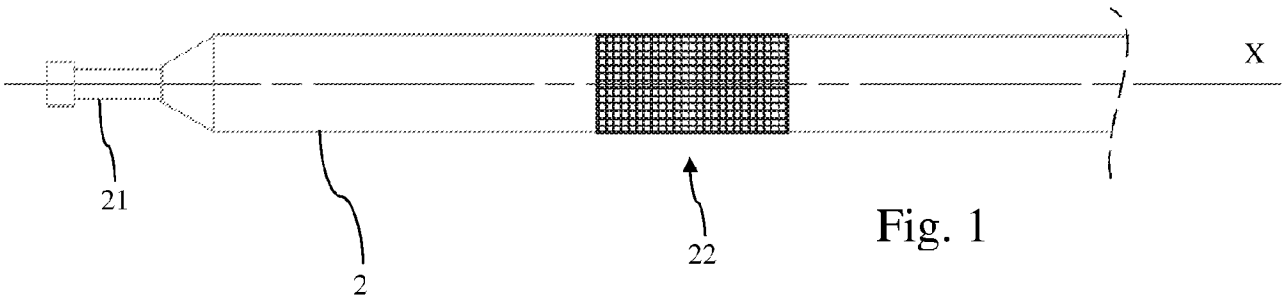
FIG. 1 shows, in axial section, a part of a component of an armoured resistor according to the present invention.
Figure 2:
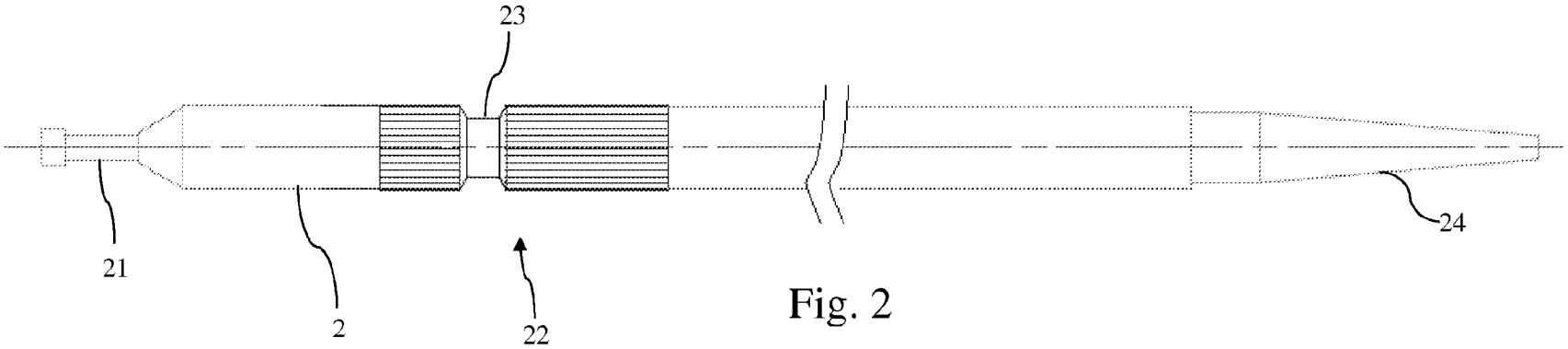
FIG. 2 shows, in axial section, a variant of the component in FIG. 1 of the type without a safety device.
Figure 3:
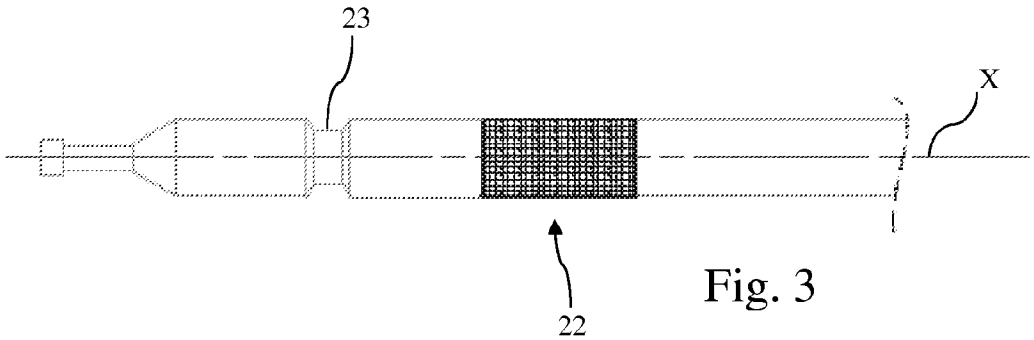
FIG. 3 shows, in axial section, a first variant of the component in FIG. 2.
Figure 4:
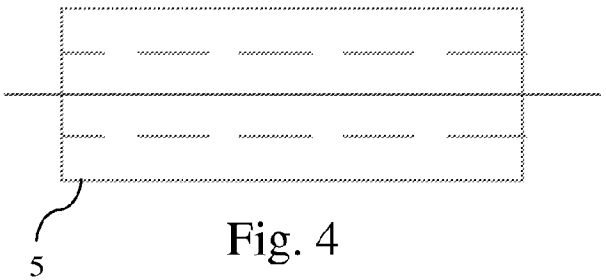
FIG. 4 shows, in axial section, another component of the armoured resistor.

When the electric pin comprises both a knurled/toothed zone etc., and at least one circular groove 23, the latter can be both internal and external to said knurled zone, see for example FIGS. 2 and 3.

Figure 6:
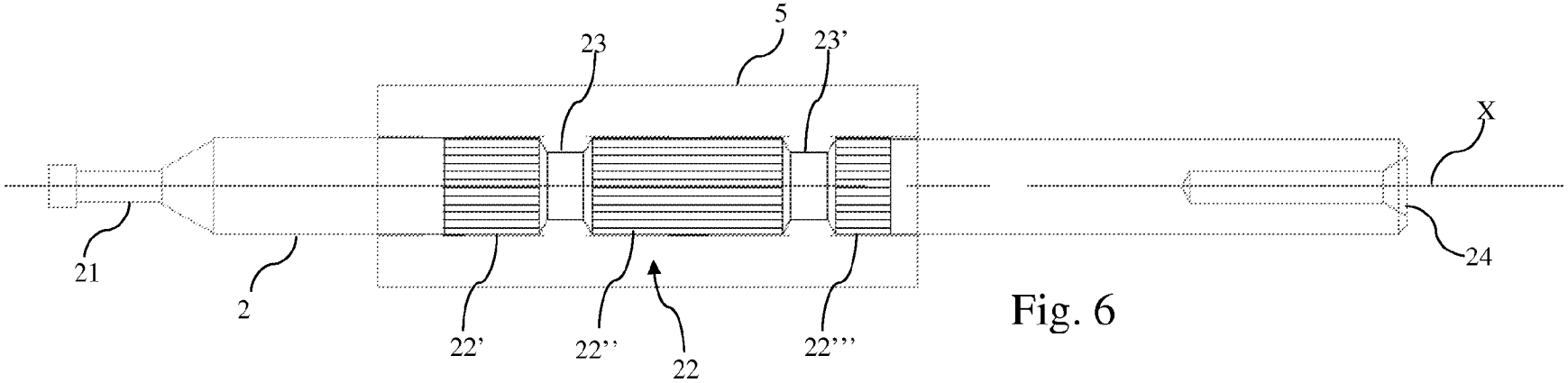
FIG. 6 shows, in axial section, a third variant of the component in FIG. 2 including the component shown in FIG. 4.

In the example of FIG. 6, electric pin 2 comprises two circular grooves 23 and 23', which demarcate three separate portions 22', 22" and 22'" of longitudinal knurling or toothing.

Advantageously, said knurling or toothing 22', 22", 22'" enables the armoured resistor to withstand a torque applied to the electric pin of the order of 100 Ncm or more.

Meanwhile, said circular grooves 23, 23', etc. do not have any component parallel to the axial extension of the electric pin, but improve the adhesion of electric pin to the bead 5 for the purpose of resisting axial stresses, for example during connection or disconnection of the tapered end 21 in a suitable external electrical connector.

According to a preferred embodiment of the invention, following preparation of a electric pin 2 according to one of the examples described above, a sealing bead 5 made of plastic or fluorinated materials, a tube-shaped metal armour 1, a method of assembly of the armoured resistor envisages the following steps:

- positioning said sealing bead 5 on said electric pin, so that this engages the internal cavity of the sealing bead 5 and so that said second part 22 is at least partially in contact with the sealing bead 5
- pressing/coining/rolling of said end 1' of said armour 1 and defining a circular crimping of the same end in order to compress radially said sealing bead 5;

where radially means any direction perpendicular to the axis of symmetry of the sealing bead.

Said positioning is such that said sealing bead 5 also covers at least one groove 23, when present.

The method can comprise a preliminary step of juxtaposition of electric pin 2 with the associated resistance wire in armour 1 and a further step of filling the armour with powder of insulating material, such as magnesium oxide, optionally mixed or treated with silicone resins.

It is clear from the description of the method that the operation of pressing/coining/rolling induces elastoplastic deformations in the sealing bead 5 which cause it to interpenetrate in the interstices due to the local asymmetry of the second part 22 of electric pin 2, including said knurling/toothing and/or said at least one circular groove 23, 23', when present.

Figure 9:
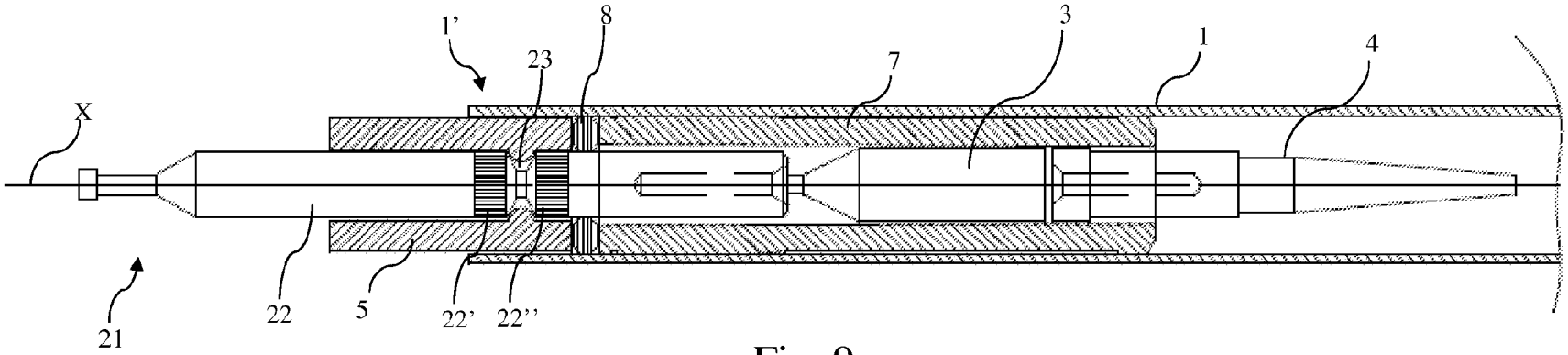
Figure 10:
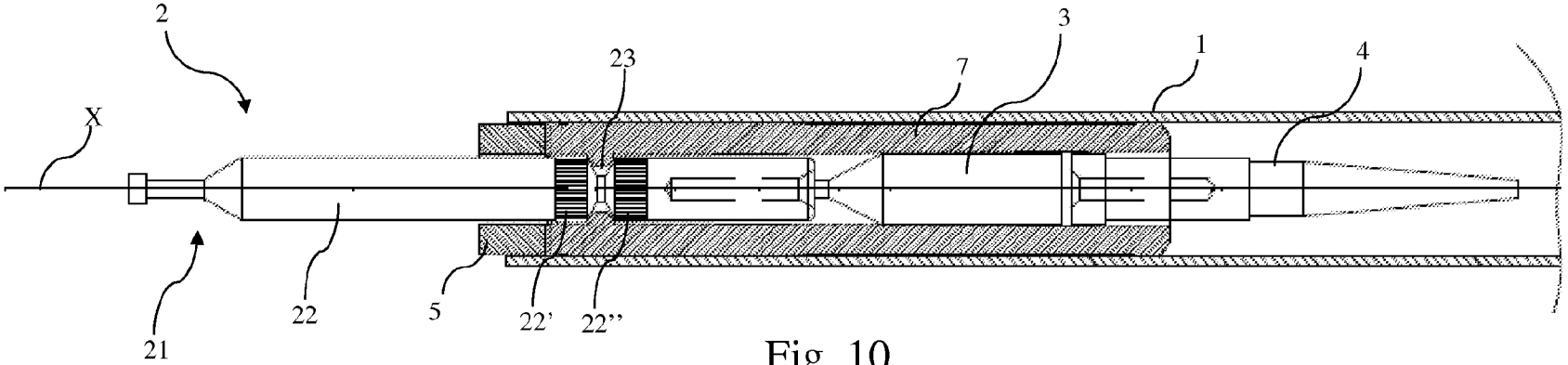
FIG. 10 shows, in axial section, a further preferred embodiment of the armoured resistor of FIG. 1.

In FIG. 9 it can be seen that the bead interpenetrates, after rolling, a circular groove 23 in electric pin 2.

It is therefore preferable for said sealing bead 5 to be of plastic material, or PTFE, PFA so that it deforms suitably to adhere to said roughness.

Thus, considered together, the electric pin 2, the sealing bead 5 and the end 1' of the armour 1 become one, also owing to the synergistic effect of the conformation of said electric pin 2 and of the permanent deformations induced in end 1' of the armour, which in their turn cause the sealing bead 5 to deform.

Said assemblage enables the armoured resistor to withstand a force of compression and/or tension applied to each electric pin equal to 100N or more, without the electric pin moving axially relative to the armour.

According to a preferred embodiment of the invention, said armour 1 can comprise, according to the axial section in FIG. 7, a stop tooth 11, defining the portion of the sealing bead 5 intended to be inside the armour, to facilitate the operation of positioning of the bead 5.

Furthermore, it is preferable for the magnesium oxide, used for filling the armour and isolating electrically the resistance wire passing through it internally, to be mixed with silicone material with characteristics of water repellence.

The characteristics of the electric pin 2 shown apply indiscriminately to caps intended to be connected to a thermal fuse, see end 24 in FIG. 6, and to caps intended to be connected directly to a resistance wire, see end 24 in FIG. 2.

The present invention offers the possibility of beneficial use of sealing elements 5 made of plastic or fluorinated material.

Figure 8:
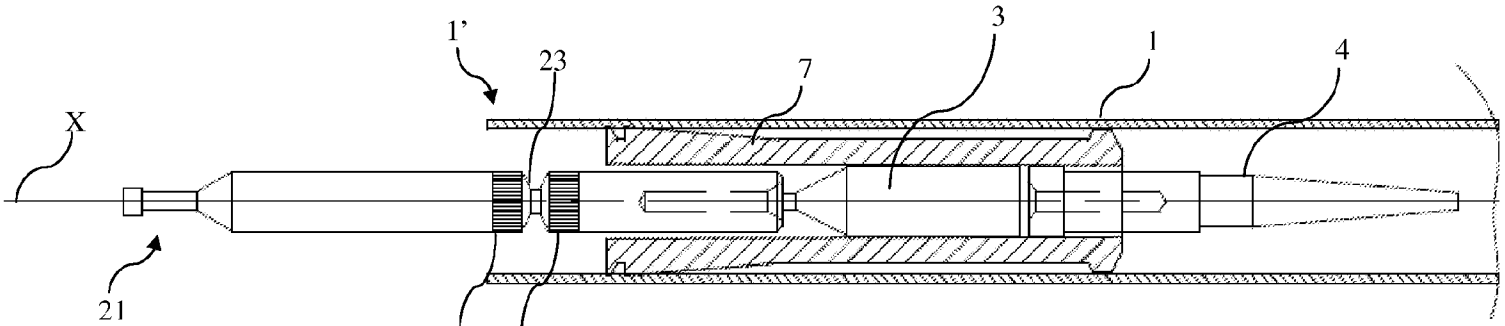
FIGS. 8 and 9 show, in axial section, a preferred embodiment of the armoured resistor of FIG. 1.

According to another preferred embodiment of the invention, represented with the aid of FIGS. 8 and 9.

According to this preferred embodiment, in addition to the sealing bead 5, there is a so-called bushing 7, generally made of plastic material. This bushing generally has the purpose of keeping the thermal fuse coaxial with the armour. This does not rule out other possible purposes.

According to this preferred embodiment of the invention, the sealing bead and the bushing are dimensioned so that they are axially contiguous inside the armour.

According to a particular aspect of the invention, an annular gasket 8, preferably an O-ring, is interposed between the sealing bead 5 and the bushing 7.

This gasket, interacting with the sealing bead 5, the bushing 7 and the armour 1, guarantees perfect sealing of the interior of the armour, preventing the ingress of moisture that would impair the characteristics of electrical insulation of said armoured resistor.

In particular, FIG. 8 shows the resistor during a preferred method of manufacture in which bushing 7 is inserted in the armour. Moreover, FIG. 9 shows the resistor after:

insertion of the O-ring, insertion of the sealing bead 5 rolling/pressing/coining of the armour.

Rolling envisages a radial reduction of the armour, which thus becomes narrower, locking inside it both the bushing 7, which in FIG. 9 is shown deformed, and the sealing bead 5: the latter locking between them the O-ring in peripherally external contact with the armour.

As can be seen from FIG. 9, it is preferable for the O-ring to have dimensions such that it is in contact externally with the armour and internally with the electric pin 2.

This effect can advantageously be amplified by compressing the O-ring between the bushing and the bead.

It is clear what is meant by peripherally internal and external, the shape of the O-ring being known and its arrangement being clear inside the armoured resistor having cylindrical symmetry.

This does not stop the gasket being effective even in the case of resistors that do not have cylindrical symmetry, for example as a result of pressing of the resistor, causing its section to assume a substantially oval section.

The rolling process envisages working the armour by means of rolls, which gradually reduce the radial dimensions, according to a transverse section, of the armour, uniformly in the radial and longitudinal direction. Coining is a process that reduces the radial dimensions of the armour locally. Pressing is a process that involves a portion of the armour, producing a uniform or non-uniform reduction of its radial dimensions on a fairly extensive region of the armour, but not on the whole armour.

According to a further embodiment of the invention, the knurled/toothed part 22', 22", etc., of electric pin 2 is in contact with the bushing 7, so that the latter has to perform a mechanical function of connection of the electric pin 2 to the armour 1, applying to this everything said previously in relation to the sealing bead 5, for example in relation to coining or rolling of the armour. Since the bushing is internal, it is not necessary for it to have particular characteristics of hermeticity against moisture and foreign bodies, and it can, advantageously, be made of poor material. In this case, the sealing bead 5 performs the sole task of sealing the armour and no longer of holding the electric pin, so that, rather than being made of expensive Teflon, it can be made of more economical silicone material.

The elements and characteristics illustrated in the various preferred embodiments can be combined while remaining within the scope of protection of the present application.

The invention claimed is:

1. An armoured resistor with two caps, of domestic appliances, comprising an armour having two opposite ends, one first end of said opposite ends defining an axis of longitudinal extension (X), an electric pin partially projecting from said first end and connected to said first end by an annular element with axial symmetry comprising a through-cavity engaged by said electric pin so that the electric pin is coaxial with said axis of longitudinal extension (X), a thermal fuse arranged internally in said armour and electrically connected to said electric pin, the electric pin having a portion of peripheral surface in contact with the through-cavity of said annular element, characterized in that said portion of peripheral surface comprises knurling or toothing defining at least one component of extension parallel to said axis of longitudinal extension (X).

2. The resistor according to claim 1, wherein said portion of peripheral surface comprises at least one peripheral circular groove.

3. The resistor according to claim 1, wherein said first end of the armour is deformed so that said annular element interpenetrates with said peripheral surface.

4. The resistor according to claim 1, wherein said peripheral surface comprises only toothing with parallel extension relative to said axis of longitudinal extension (X).

5. The resistor according to claim 1, wherein said annular element is a sealing bead.

6. The resistor according to claim 5, wherein the sealing bead is made of plastic material or fluorinated material (PTFE-PFA).

7. The resistor according to claim 5, further comprising a bushing with axial symmetry encircling said thermal fuse inside the armour.

8. The resistor according to claim 7, wherein said bushing and said sealing bead are contiguous with respect to said axis of longitudinal extension (X).

9. The resistor according to claim 8, further comprising a gasket of annular shape interposed between said sealing bead and said bushing in order to encircle said electric pin.

10. The resistor according to claim 1, wherein said annular element is a bushing made of plastic material or fluorinated material (PTFE-PFA) encircling said thermal fuse inside the armour and in which said sealing element is made of silicone material.

11. A Method of assembly of an armoured resistor according to claim 1 comprising the following successive steps:

positioning said annular element on the electric pin, so that said electric pin engages the through-cavity of the annular element and so that the portion of peripheral surface is at least partially in contact with said through-cavity, pressing/coining/rolling said first end of the armour so as to produce a circular crimping of the first end in order to compress radially said annular element.

12. The method according to claim 10, wherein said annular element is a sealing bead and further comprising the preliminary steps of providing a further bushing for encircling the thermal fuse inside the armour and of interposing an annular gasket between said bushing and said sealing bead.

* * * * *

UNITED STATES PATENT AND TRADEMARK OFFICE

CERTIFICATE OF CORRECTION

PATENT NO. : 9,293,283 B2
APPLICATION NO. : 13/701265
DATED : March 22, 2016
INVENTOR(S) : Roberto Colombo et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 461 days.

Signed and Sealed this
Sixteenth Day of August, 2016

Michelle K. Lee

Michelle K. Lee
*Director of the United States Patent and Trademark Office*